United States Patent [19]

Phillips

[11] 3,942,630

[45] Mar. 9, 1976

[54] SLIDING COVER SAFETY PACKAGE

[75] Inventor: Otto Phillips, London, Canada

[73] Assignee: International Tools (1973) Limited, Windsor, Canada

[22] Filed: Nov. 22, 1974

[21] Appl. No.: 526,186

[52] U.S. Cl. ..... 206/1.5; 215/201; 220/329; 220/346

[51] Int. Cl.[2] ..... B65D 43/20; B65D 85/56

[58] Field of Search ..... 206/1.5, 536, 540; 215/223, 322, 9; 220/329, 346, 348, 351

[56] References Cited

UNITED STATES PATENTS

| | | | |
|---|---|---|---|
| 2,133,651 | 10/1938 | Baker | 206/536 |
| 3,604,582 | 9/1971 | Boudin et al. | 215/223 X |
| 3,756,445 | 9/1973 | Hedgewick | 215/222 |
| 3,782,584 | 1/1974 | Swenson et al. | 220/346 |
| 3,820,676 | 6/1974 | Mucsi | 215/9 |
| 3,866,802 | 2/1975 | Birrell | 215/9 X |

*Primary Examiner*—Steven E. Lipman
*Attorney, Agent, or Firm*—Reising, Ethington, Barnard, Perry & Brooks

[57] ABSTRACT

A sliding cover safety package including a container having a cover mounted thereon for slidable movement between open and closed positions with respect to the container. The container and cover are provided with locking lugs having a locked position when the cover is closed in which the cover is locked against movement from its closed position with respect to the container, and an unlocked position when the cover is closed in which the cover can slide with respect to the container to its open position. The locking lugs are movable between the locked and unlocked positions by axial movement of the cover with respect to the container. Resilient biasing members is engaged between the container and cover to bias the locking lugs to the locked position such that the cover can slide from its closed position with respect to the container only after axial movement of the cover with respect to the container against the biasing members.

5 Claims, 6 Drawing Figures

SLIDING COVER SAFETY PACKAGE

BACKGROUND OF THE INVENTION

1. Field of the Invention

This invention relates generally to safety packages, and is particularly concerned with a sliding cover safety package of the type including a container with a cover mounted thereon for slidable movement between open and closed positions with respect to the container.

2. Description of the Prior Art

In order to reduce the number of accidental poisonings resulting from young children having access to unsafe medicines, drugs and other potentially dangerous substances, considerable effort has been made toward developing child-proof safety packaging. To fulfill the criteria of a child-proof safety package, a container and cap or cover must be constructed in such a manner that the type of manipulation required to open the container to gain access to its contents is one that a young child is not capable of performing. Examples of prior art safety packages are disclosed in U.S. Pat. Nos. 3,344,942; 3,432,065; 3,623,623; 3,753,510; 3,756,445; 3,819,090; and 3,830,413. The safety packages disclosed in the latter patents are of the type wherein a cap must be pushed axially toward the container against a biasing force, and then rotated with respect to the container in order to remove the cap from the container. It has been found that a young child is generally incapable of of performing this type of manipulation.

SUMMARY OF THE INVENTION

An object of this invention is to provide a sliding cover safety package of the type wherein a container has a cover mounted thereon for slidable movement between open and closed positions with respect to the container.

A more specific object is to provide a sliding cover safety package wherein a cover is mounted on a container for slidable movement between open and closed positions, and wherein locking means is provided on the container and cover having a locked position when the cover is closed in which the cover is locked against movement from its closed position and an unlocked position when the cover is closed in which the cover can slide with respect to the container to its open position, the locking means being movable between the locked and unlocked positions by axial movement of the cover with respect to the container and being biased to its locked position.

In carrying out the foregoing, and other objects, a safety package according to the present invention includes a container having a cover mounted thereon for slidable movement between open and closed positions. The container and cover are provided with locking means having locked and unlocked positions when the cover is closed. In the locked position, the cover is locked against movement from the closed position. The locking means is movable between the locked and unlocked positions by axial movement of the cover with respect to the container. Resilient biasing means is engaged between the container and the cover and biases the locking means to the locked position so that the cover can slide from its closed position only subsequent to axial movement of the cover wth respect to the container against the biasing means.

The locking means includes a plurality of cover locking elements on the cover and container locking elements on the container, the container locking elements being disposed in the path of sliding movement of the cover locking elements in the locked position. In the unlocked position, the container locking elements are axially displaced from the cover locking elements and are thus disposed out of the path of movement of the cover locking elements to permit sliding movement of the cover. The biasing means comprises resilient flexible members integrally formed on the cover and engaging the container to biasing the locking means toward the locked position. Consequently, in order to move the cover from the closed to the open position, the cover must first be pushed axially toward the container against the biasing means, and then slidably moved to the open position.

Other objects, advantages and features of the invention will become apparent from the following description taken in connection with the accompanying drawings.

Figure 1:
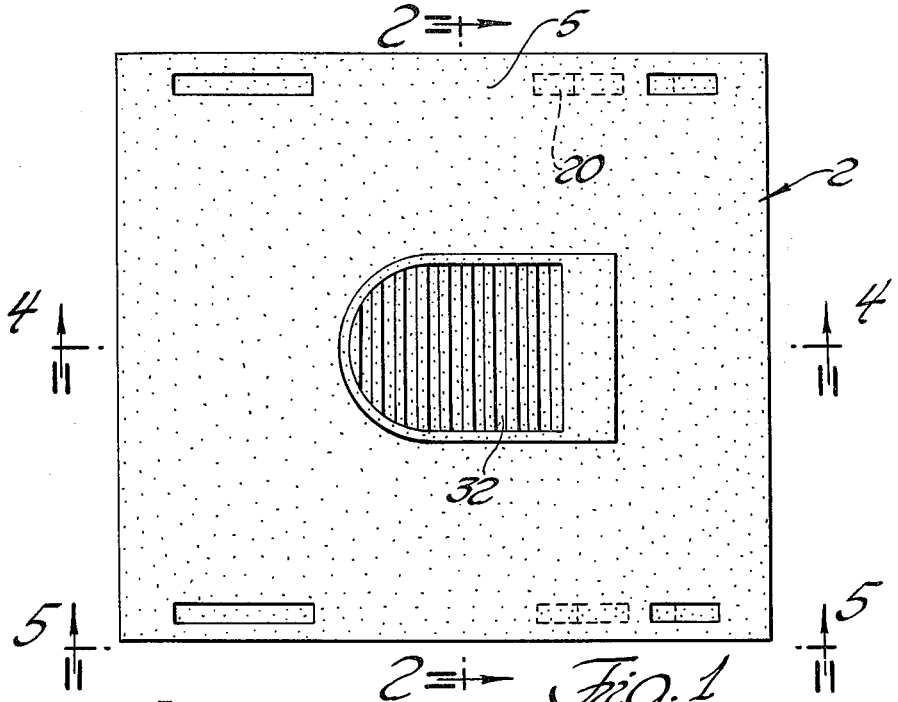
FIG. 1 is a plan view of a safety package embodying the present invention with the cover of the safety package shown in the closed position.

In the drawings, a safety package embodying the present invention includes a container designated collectively by reference numeral 4 and a cover designated collectively by reference numeral 2. The cover 2 is slidably mounted on the container 4 for movement between open and closed positions with respect to the container. The cover is illustrated in the closed position in FIGS. 1 and 2, an open position being illustrated in phantom lines in FIG. 6.

Figure 4:
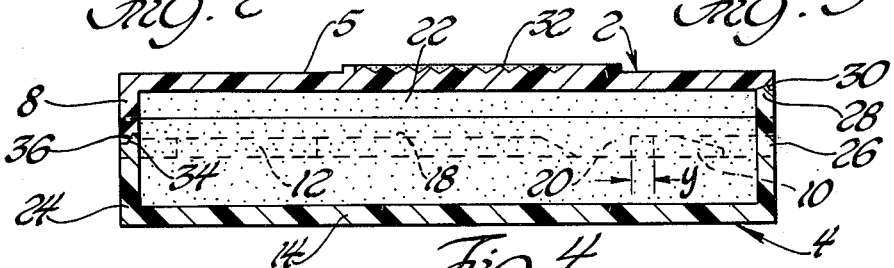
FIG. 4 is a sectional view taken on lines 4—4 of FIG. 1.
Figure 7:
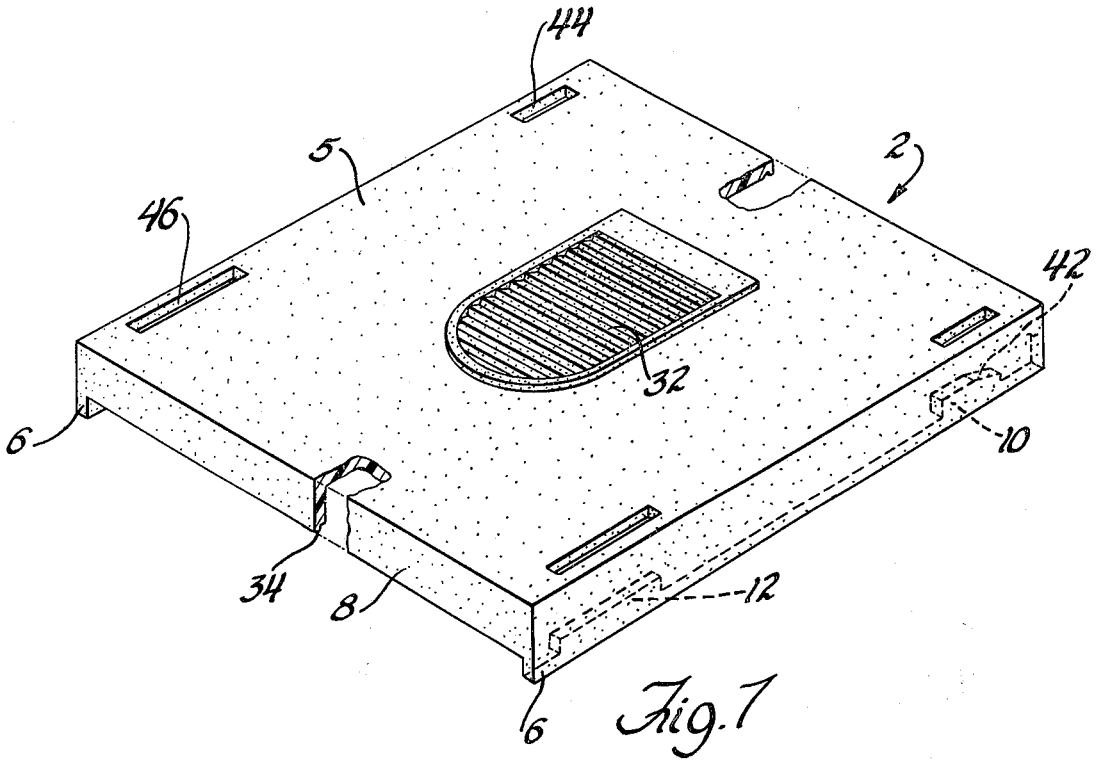
FIG. 7 is a perspective view of the cover of the safety package of FIG. 1.

The cover 2 has a base portion 5 and a pair of side skirt members 6 depending from the side edges of the base. An end skirt 8 depends from one of the end edges of the base 5, as shown in FIGS. 4 and 7. Cover locking elements in the form of lugs 10 project inwardly from the inner surface of the side skirt members 6. Lugs 10 are integrally formed on the cover 2. Lugs 10 are formed on the cover adjacent the right-hand end of the cover as viewed in FIGS. 4 and 7. Slide members 12 are formed on the inner surface of the side skirt members 6 near the end of the side skirt members opposite the locking lugs 10.

Figure 8:
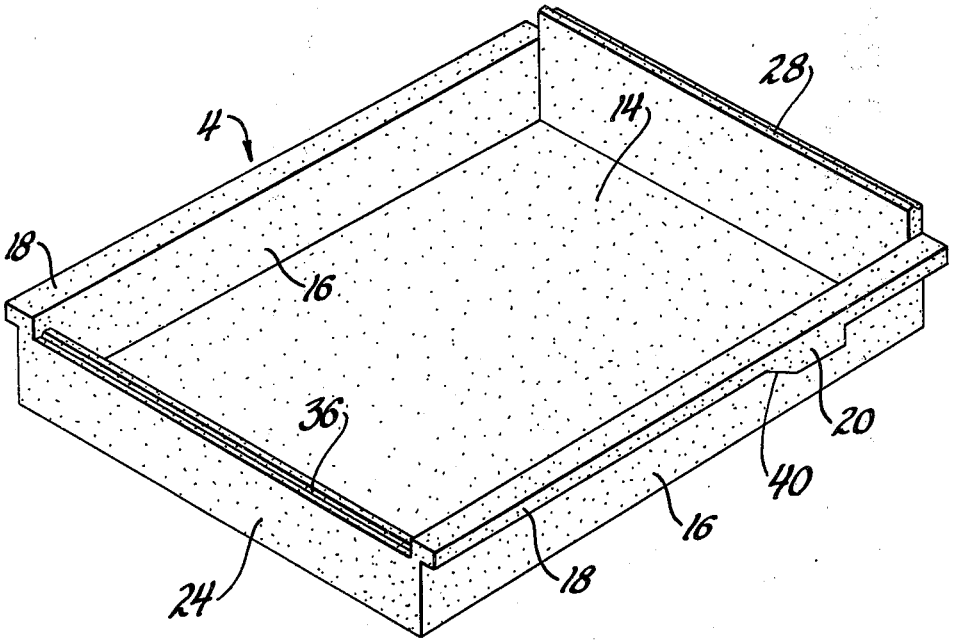
FIG. 8 is a perspective view of the container of the safety package of FIG. 1.

The container 4 includes a bottom wall 14. A pair of side wall members 16 project upwardly from the side edges of the bottom wall 14. A flange 18 projects outwardly from the upper edge of each of the side wall members 16. A container locking lug 20 depends from the flange 18 (FIGS. 4, 6 and 8) intermediate the ends of flange 18.

Figure 2:
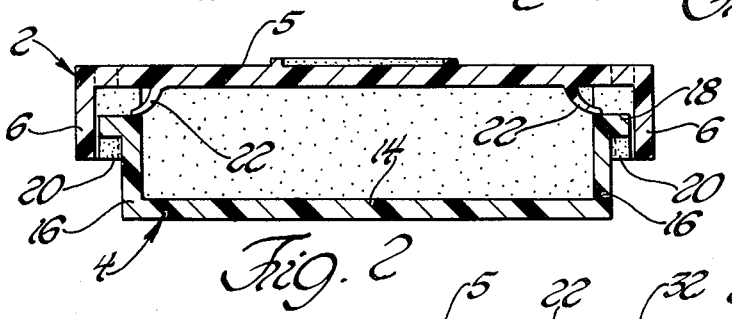
FIG. 2 is a sectional view taken on lines 2—2 of FIG. 1 with the locking means shown in the locked position.
Figure 3:
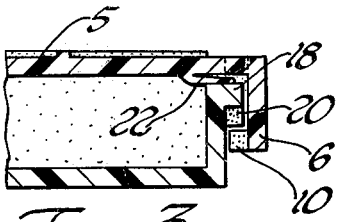
FIG. 3 is a partial sectional view similar to FIG. 2 showing the locking means in the unlocked position.
Figure 5:
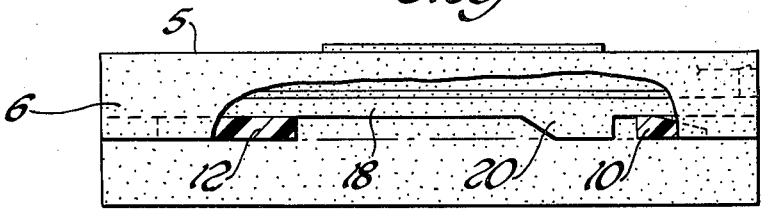
FIG. 5 is an elevational view taken on lines 5—5 of FIG. 1 with a portion of the cover broken away to illustrate the locking elements in the locked position.
Figure 6:
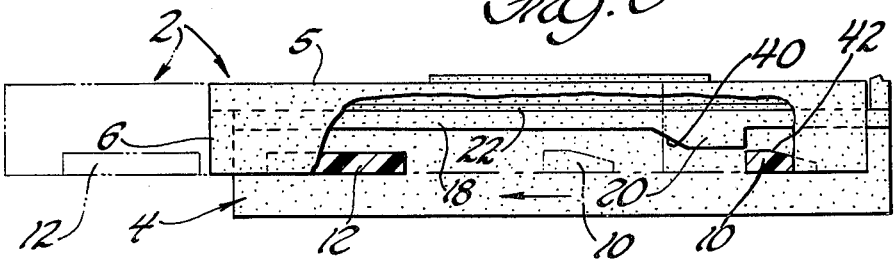
FIG. 6 is a view similar to FIG. 5 with the locking elements shown in the unlocked position.

The cover locking elements 10 and container locking elements 20 constitute locking means having a locked position illustrated in FIGS. 2, 4 and 5 in which the cover is locked against movement from its closed position, and an unlocked position illustrated in FIGS. 3 and 6, in which the cover can slide with respect to the container to an open position. In the locked position, the container locking elements 20 are disposed in the path of sliding movement of the cover locking elements 10 to prevent the cover 2 from sliding toward the left as viewed in FIGS. 4, 5 and 6 to an open position. In the unlocked position, the cover locking elements 10 are axially displaced beneath the container locking elements 20 so that the container locking elements 20 are out of the path of the cover locking elements 10 as shown in FIGS. 3 and 6.

The locking means 10, 20 is biased to the locked position by resilient biasing means engaged between the container 4 and cover 2 such that the cover can slide from its closed position with respect to the container only subsequent to axial movement of the cover toward the container against the biasing means. The biasing means comprises a pair of spaced, parallel, resilient flexible spring members 22 depending from the base portion 5 of the cover and engaging the side wall members 16 at the upper edges thereof. Each of the spring members 22 extends substantially the length of the base portion 5 in parallel relationship with the side skirt members, and each projects downwardly and outwardly from the base portion and terminates in a free end overlying and engagable with the upper edge of the respective side wall members from which the flange 18 projects. As shown in FIGS. 2 and 4, in the closed and locked position of the cover 2 with respect to the container 4, the spring members 22 bias the cover to an axial position with respect to the container in which the cover locking lugs 10 and slide members 12 engage the under side of the outwardly projecting flanges 18. When the cover is pushed axially toward the container 4, as shown in FIGS. 3 and 6, the spring members 22 deflect and the cover locking elements 10 and slide members 12 move axially downwardly as viewed in the drawing with respect to the container 4 and are displaced from the flange 18. In the unlocked position, the cover can slide to the left as viewed in FIG. 6 to an open position with respect to the container as illustrated in phantom lines in FIG. 6 to permit access to the interior of the container.

In the closed and locked position of the safety package illustrated in FIGS. 1, 2, 4 and 5, the cover is resiliently latched against longitudinal or sliding movement with respect to the container by interengagable latching means on the cover and container. The container 2 is provided with end wall members 24 and 26 extending between the side wall members 16. The interengagable latching means is provided by a rib 28 formed on the upper edge of the end wall member 26, and a complementary groove 30 formed in the base portion 5 of the cover 2 near the edge thereof opposite the edge from which the end skirt 8 depends. The rib 28 must be resiliently snapped into engagement with the groove 30 since the rib 28 projects above the plane of the inner surface of the base portion 5 when the lugs 10 and slide members 12 are in engagement with the flange 18. Consequently, in order to move the cover 2 from the locked position to the unlocked position, the cover 2 must be shifted to the left to disengage the base portion 5 from the end wall 26 so that the cover can be pushed axially toward the container 4 to the position as shown in FIG. 6. Thus, in the closed and latched position illustrated in FIG. 4, the cover locking lugs 10 are spaced longitudinally from the container locking lugs 20 a distance *y* to permit the cover to become unlatched from the container by disengaging the groove 30 from the rib 28.

For assisting in the unlatching movement of the cover with respect to the container, a serrated portion 32 is formed on the upper surface of the base portion 5 which may be engaged by the thumb of the operator to assist in moving the cover to the left as shown in FIG. 4 to disengage the rib 28 from the groove 30.

The serrated portion 32 may also be utilized to return the cover to its closed position from an open position. In order to prevent overtravel of the cover 2 as it slides to the closed position, cooperating stop ribs 34 and 36 are formed on the end skirt 8 and end wall 24, respectively of the cover and container. The stop rib 34 on the end skirt 8 of the cover engages the stop rib 36 on the end wall member 24 of the container as the cover assumes the closed position with respect to the container.

An inclined cam surface 40 is formed on each of the container locking lugs 20 for cooperation with an inclined cam surface 42 on the respective cover locking elements 10 to assist in closing the cover.

Openings 44 and 46 are formed on opposite sides of the base portion of the cover (FIG. 7) overlying locking lugs 10 and slide members 12, respectively. The sizes of the openings 44 and 46 are such that the upper surfaces of the lugs 10 and slide members 12 can be formed during molding, by mold elements projecting through the openings.

While a specific form of the invention as illustrated in the accompanying drawings and is described in the foregoing specification, it should be understood that the invention is not limited to the exact construction shown. To the contrary, various alterations in the construction and arrangement of parts, all falling within the scope and spirit of the invention, will be apparent to those skilled in the art.

The embodiments of the present invention in which an exclusive property or privilege is claimed are defined as follows:

1. A sliding cover safety package comprising: a container having a cover mounted thereon for longitudinal slidable movement in one direction from a closed position with respect to said container to an open position, and in the opposite direction to return from said open position to said closed position; said cover having a base portion and a pair of spaced, parallel side skirt members depending therefrom; a cover locking element projecting inwardly from each side skirt member near one end thereof; a slide member projecting inwardly from each side skirt member near the other end thereof; said container having a pair of spaced, parallel side wall members received between said side skirt members, and a pair of spaced end wall members extending between said side wall members; a flange projecting outwardly from the end of each of said side wall members and overlying the cover locking member and slide member of the adjacent side skirt member; a container locking member depending from each of said flanges intermediate the ends thereof; said cover having a closed and locked position with respect to said container in which said base portion completely overlies the space enclosed by said side wall members and end wall members of said container and is spaced from said flanges in a fixed axial position with respect thereto, and in which said cover locking elements and slide members engage the underneath side of the respective flanges of said container with each of said container locking members being located in the path of a respective one of the cover locking elements to prevent sliding movement of the respective cover locking element along said flange in said one direction; cooperating stop elements on said container and cover preventing movement of said cover in said opposite direction with respect to said container when said cover is in the closed position; said cover having an unlocked position in which the space between said base portion and said flanges is reduced to displace said slide members and container locking elements from the underneath sides of the respective flanges with the container locking elements out of the path of movement of the respective cover locking elements to permit movement of said cover in said one direction with respect to said container; and a pair of spaced elongated spring members extending between said container and cover in parallel relationship with said side walls; each of said spring members being integrally formed on one of said cover and container and having a free edge slidably engaging the other of said cover and container to resiliently bias said base to said fixed axial position and hence said cover to said locked position to permit movement of said cover from said closed position only subsequent to deflection of said spring members by movement of said base toward said flanges from said fixed axial position.

2. A safety package as claimed in claim 1 wherein each of said spring members is integrally formed on the base of said cover and depends therefrom with its free edge slidably engaging the end of the respective side wall of the container.

3. A sliding cover safety package as claimed in claim 1 further including interengagable latching means formed on said cover and container for resiliently latching said cover in a latched position against longitudinal movement with respect to said cover from the closed position.

4. A sliding cover safety package as claimed in claim 3 wherein said latching means is disengagable by slight opening movement of said cover against the resilient force of said latching means, and wherein said container locking elements are spaced longitudinally from the respective container locking elements in the closed and latched position of the cover a distance sufficient to permit said slight opening movement of said cover before said cover locking elements come into engagement with said container locking elements.

5. A sliding cover safety package comprising: a container having a cover mounted thereon for longitudinal slidable movement in one direction from a closed position with respect to said container to an open position, and in the opposite direction to return from said open position to said closed position; said cover having a base portion and a pair of spaced, parallel side skirt members depending therefrom; a cover locking element projecting inwardly from each side skirt member near one end thereof; a slide member projecting inwardly from each side skirt member near the other end thereof; said container having a pair of spaced, parallel side wall members received between said side skirt members, and a pair of spaced end wall members extending between said side wall members; a flange projecting outwardly from the end of each of said side wall members and overlying the cover locking member and slide member of the adjacent side skirt member; a container locking member depending from each of said flanges intermediate the ends thereof; said cover having a closed and locked position with respect to said container in which said base portion completely overlies the space enclosed by said side wall members and end wall members of said container and is spaced from said flanges in a fixed axial position with respect thereto, and in which said cover locking elements and slide members engage the underneath side of the respective flanges of said container with each of said container locking members being located in the path of the respective one of the cover locking elements to prevent sliding movement of the respective cover locking element along said flange in said one direction; an end skirt extending between said side skirts at said other ends thereof; cooperating stop ribs formed on said end skirt and the adjacent end wall engageable in the closed position of said container to prevent movement of said cover in said opposite direction with respect to said container when said cover is in the closed position; said cover having an unlocked position in which the space between said base portion and said flanges is reduced to displace said slide members and container locking elements from the underneath sides of the respective flanges with the container locking elements out of the path of movement of the respective cover locker elements to permit movement of said cover in said one direction with respect to said container; a pair of spaced, elongated spring members extending between a respective one of the side walls of said container and the base of said cover in parallel relationship with said side walls; each of said spring members being integrally formed on one of said respective side walls and base of said cover with a free edge slidably engaging the other of said respective container side walls and base of said cover to resiliently bias said base to said fixed axial position and hence said cover to said locked position to permit movement of said cover from said closed position only subsequent to deflection of said spring members by movement of said base toward said flanges from said fixed axial position; and interengageable latching means formed on said cover and container for resiliently latching said cover in a latched position against movement in said one direction with respect to said cover from said closed and locked position, said latching means being disengageable by slight movement of said cover in said one direction against the resilient force of said latching means, said container locking elements being spaced longitudinally from the respective cover locking elements when the cover is closed and latched with the base portion thereof in said fixed axial position to permit the cover to move in said one direction a distance sufficient to permit slight opening movement of said cover before said cover locking elements come into engagement with said container locking elements.

* * * * *